US011440161B2

(12) United States Patent
Kobayashi et al.

(10) Patent No.: US 11,440,161 B2
(45) Date of Patent: Sep. 13, 2022

(54) POLISHING HEAD FOR FACE-UP TYPE POLISHING APPARATUS, POLISHING APPARATUS INCLUDING THE POLISHING HEAD, AND POLISHING METHOD USING THE POLISHING APPARATUS

(71) Applicant: EBARA CORPORATION, Tokyo (JP)

(72) Inventors: Kenichi Kobayashi, Tokyo (JP); Tetsuji Togawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 835 days.

(21) Appl. No.: 16/239,302

(22) Filed: Jan. 3, 2019

(65) Prior Publication Data

US 2019/0210187 A1 Jul. 11, 2019

(30) Foreign Application Priority Data

Jan. 5, 2018 (JP) ..... JP2018-000729

(51) Int. Cl.

| | |
|---|---|
| ***B24B 57/02*** | (2006.01) |
| ***B24B 53/017*** | (2012.01) |
| ***B24B 37/04*** | (2012.01) |
| ***B24B 37/26*** | (2012.01) |

(52) U.S. Cl.

CPC ..... *B24B 57/02* (2013.01); *B24B 37/042* (2013.01); *B24B 53/017* (2013.01); *B24B 37/26* (2013.01)

(58) Field of Classification Search

CPC ..... B24B 7/228; B24B 37/04; B24B 37/042; B24B 37/044; B24B 37/10; B24B 37/11; B24B 37/12; B24B 37/16; B24B 37/20; B24B 37/22; B24B 37/26

See application file for complete search history.

(56) References Cited

U.S. PATENT DOCUMENTS 5,036,630 A * 8/1991 Kaanta ..... B24B 37/015 451/41
6,165,056 A * 12/2000 Hayashi ..... B24B 41/068 451/281
6,386,956 B1 * 5/2002 Sato ..... B24B 27/0076 451/57

(Continued)

FOREIGN PATENT DOCUMENTS

CN 103100966 A 5/2013
CN 205413373 U 8/2016

(Continued)

*Primary Examiner* — Joel D Crandall
(74) *Attorney, Agent, or Firm* — BakerHostetler

(57) ABSTRACT

A polishing liquid is supplied without passing through a rotary joint in a face-up type polishing apparatus. This application discloses a polishing head for the face-up type polishing apparatus used by mounting a polishing pad on a lower surface as one embodiment. The polishing head includes a liquid reservoir portion that receives a liquid and a liquid discharge port that discharges the liquid received by the liquid reservoir portion. The liquid reservoir portion is disposed around a rotation axis of the polishing head. The liquid discharge port is disposed on the lower surface of the polishing head. An annular opening centering on the rotation axis of the polishing head is formed on an upper portion of the polishing head. The liquid reservoir portion is communicated with a space outside the polishing head via the opening.

14 Claims, 5 Drawing Sheets

(56) References Cited

U.S. PATENT DOCUMENTS

2005/0107016 A1* 5/2005 Hoshino ..... B24B 41/061
451/287

FOREIGN PATENT DOCUMENTS

| | | | |
|---|---|---|---|
| JP | H02-145254 | A | 6/1990 |
| JP | H10-015823 | A | 1/1998 |
| JP | H11-135463 | A | 5/1999 |
| JP | 2015-134383 | A | 7/2015 |

* cited by examiner

POLISHING HEAD FOR FACE-UP TYPE POLISHING APPARATUS, POLISHING APPARATUS INCLUDING THE POLISHING HEAD, AND POLISHING METHOD USING THE POLISHING APPARATUS

CROSS-REFERENCE TO RELATED APPLICATION

This application is based upon and claims benefit of priority from Japanese Patent Application No. 2018-000729 filed on Jan. 5, 2018, the entire contents of which is incorporated herein by reference.

TECHNICAL FIELD

The present invention relates to a polishing head for a face-up type polishing apparatus, a polishing apparatus including the polishing head, and a polishing method using the polishing apparatus.

BACKGROUND ART

There exists a Chemical Mechanical Polishing (CMP) apparatus as one type of a substrate polishing apparatus used in a semiconductor processing operation. The CMP apparatus can be roughly divided into a "face-up type ((an apparatus that employs a) method where a polished surface of a substrate faces upward)" and a "face-down type ((an apparatus that employs a) method where the polished surface of the substrate faces downward)," depending on a direction that the polished surface of the substrate faces.

PTL 1 (Japanese Unexamined Patent Application Publication No. H10-15823, especially see FIG. 4, Paragraph 0005, and Paragraph 0006) discloses that, when a polishing liquid is supplied onto a substrate in a face-up type CMP apparatus, the polishing liquid does not fully spread to the center of a polishing pad. PTL 1 further discloses that, when the polishing liquid is supplied onto the substrate in the face-up type CMP apparatus, it is necessary to supply the polishing liquid with an amount more than an amount originally required for polishing. Accordingly, PTL 1 (especially see FIG. 1(a)) discloses a face-up type CMP apparatus that supplies the polishing liquid to a polished surface via a through-hole provided at a rotatable polishing head. The CMP apparatus in PTL 1 is further configured to suction the polishing liquid from the polished surface via the through-hole provided at the polishing head.

CITATION LIST

Patent Literature

PTL 1: Japanese Unexamined Patent Application Publication No. H10-15823

SUMMARY OF INVENTION

Technical Problem

PTL 1 does not clearly specify a specific configuration for a connection between a slurry supply source and the polishing head, and a specific configuration for a connection between a slurry suction source and the polishing head. However, it is thought to be necessary to dispose a rotary joint (or a component or a part having a function equal to that of the rotary joint: hereinafter simply referred to as the "rotary joint") in order to supply the polishing liquid into the through-hole provided at the polishing head and suction the polishing liquid from the through-hole, since the polishing head is a rotator.

If the polishing liquid passes through the inside of the rotary joint, components (parts/members) inside the rotary joint may be degraded by a chemical reaction with the polishing liquid. Furthermore, if the polishing liquid passes through the inside of the rotary joint, abrasive grains contained in the polishing liquid may abrade the components inside the rotary joint. The degradation and/or the abrasion of the rotary joint may make the supply of the polishing liquid unstable, and may cause leakage of the polishing liquid. Accordingly, the rotary joint is preferably replaced periodically. However, a cost (for example, a material cost and a labor cost) is required for replacing the rotary joint. Additionally, it is necessary to stop the operation of the apparatus during a replacement operation. The replacement operationmay reduce the throughput of the apparatus.

There also exists a polishing liquid without the abrasive grain (an abrasive grainless polishing liquid) for the CMP apparatus. In this case, it is thought that the abrasion of the component due to the abrasive grain does not occur. However, even when the abrasive grainless polishing liquid is used, the degradation of the component due to the reaction with the polishing liquid may occur.

The above-described problem is a problem that may occur not only in the CMP apparatus but also in a face-up type polishing apparatus that supplies the polishing liquid via the rotary joint. Therefore, one object of this application is to supply a polishing liquid without passing through a rotary joint in a face-up type polishing apparatus.

Solution to Problem

This application discloses a polishing head for a face-up type polishing apparatus used by attaching a polishing pad on a lower surface as one embodiment. The polishing head includes a liquid reservoir portion that receives a liquid and a liquid discharge port that discharges the liquid received by the liquid reservoir portion. The liquid reservoir portion is disposed around a rotation axis of the polishing head. The liquid discharge port is disposed on the lower surface of the polishing head. An annular opening, centering on the rotation axis of the polishing head, is formed on an upper portion of the polishing head. The liquid reservoir portion is communicated with a space outside the polishing head via the opening.

DESCRIPTION OF EMBODIMENTS

Figure 1:
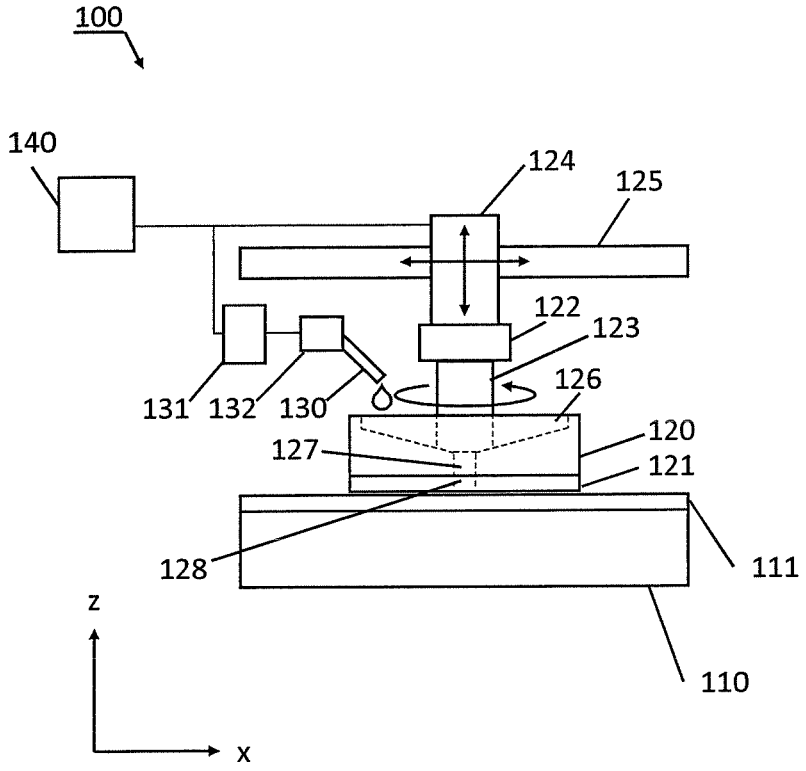
FIG. 1 is a front view of a polishing apparatus according to one embodiment.

The following describes one embodiment of the present invention by referring to the drawings. However, the drawings are schematic diagrams. Accordingly, sizes, positions, shapes, and the like of the illustrated components may differ from sizes, positions, shapes, and the like in the actual apparatus. FIG. 1 is a front view of a polishing apparatus 100 according to the one embodiment. In the following, in FIG. 1, the right-left direction is set to an X direction (the paper-right side is positive), the direction perpendicular to the paper is set to a Y direction (the paper-surface-front side is positive), and the up-down direction is set to a Z direction (the paper-surface-top side is positive).

The polishing apparatus 100 in FIG. 1 is a face-up type CMP apparatus. However, insofar as it is a face-up type polishing apparatus using a polishing liquid, the polishing apparatus 100 does not have to be the CMP apparatus. Here, the face-up type polishing apparatus is a polishing apparatus that holds a substrate such that a polished surface of the substrate faces upward, and that polishes the substrate using a polishing pad. The polishing apparatus 100 includes a surface plate 110, a polishing head 120, and a liquid supply nozzle 130. The polishing apparatus 100 further includes a control unit 140 for controlling respective elements of the polishing apparatus 100.

The surface plate 110 is disposed to support a substrate 111 to be polished. The surface plate 110 has a top surface to which the substrate 111 is detachably supported. In the example in FIG. 1, the surface plate 110 is, basically, an object that does not move. However, for example, a apparatus that moves and/or rotates the surface plate 110 may be connected to the surface plate 110. The substrate 111 may have any shape including a circular shape and a square shape.

The polishing head 120 is disposed so as to face the surface plate 110. The polishing head 120 has a lower surface on which a polishing pad 121 is detachably attached. The polishing apparatus 100 further includes a rotation apparatus 122. The rotation apparatus 122 allows the polishing head 120 to rotate about a shaft 123. Here, a rotation axis of the polishing head 120 is the Z direction. Note that the term "shaft" in this description is a term that means a "mechanical component that transmits the power with rotation," namely, a component that actually exists. The term "rotation axis" is a term that means a "straight line that corresponds to the center of rotational motion," namely, a mathematical or virtual line." The polishing apparatus 100 further includes an up-and-down motion apparatus 124 for moving the polishing head 120 in the Z direction. The lower surface of the polishing pad 121 is pressed to the top surface of the substrate 111, by the downward movement of the polishing head 120 caused by the up-and-down motion apparatus 124. The substrate 111 is polished by rotating the polishing head 120 in a state where the polishing pad 121 has been pressed to the substrate 111.

Preferably, the polishing apparatus 100 further includes a horizontal movement apparatus 125 for horizontally moving the polishing head 120. Moving the polishing head 120 with the horizontal movement apparatus 125 during the polishing of the substrate 111 allows a wide region polishing of the substrate 111. The horizontal movement apparatus 125 in FIG. 1 is configured to move the polishing head 120 in the X direction. However, the horizontal movement apparatus 125 may be a apparatus that moves the polishing head 120 in the X direction and/or the Y direction.

An air bag (not illustrated) for adjusting a pressing force between the polishing pad 121 and the substrate 111 may be disposed on the lower surface of the polishing head 120. In the example in FIG. 1, the substrate 111 is illustrated larger than the polishing pad 121. However, it is also possible to employ a configuration where the polishing pad 121 is larger than the substrate 111. The polishing head 120 may be larger or smaller than the surface plate 110. Here, "sizes" of the substrate 111, the polishing pad 121, the polishing head 120, and the surface plate 110 mean areas when they are viewed from above or below, that is, projected areas on the XY plane.

A liquid reservoir portion 126 is provided at the polishing head 120. Furthermore, a liquid discharge port 127 communicated with the liquid reservoir portion 126 to discharge the liquid received by the liquid reservoir portion 126 is provided at the polishing head 120. In other words, the liquid discharge port 127 connects the lower surface of the polishing head 120 to the liquid reservoir portion 126. A pad hole 128 is provided at the polishing pad 121 so as to correspond to the position of the liquid discharge port 127. The liquid supplied from the liquid supply nozzle 130 and received by the liquid reservoir portion 126 flows into the liquid discharge port 127 in accordance with the gravity. The liquid that has flowed in the liquid discharge port 127 reaches a polished surface of the polishing pad 121 through the pad hole 128.

While the substrate 111 is being polished, the polishing head 120 rotates. Due to the rotation of the polishing head 120, the liquid that has reached the polished surface of the polishing pad 121 receives a force toward a radial outside of the polishing head 120. Accordingly, the liquid may move to the radial outside of the polishing head 120 during the polishing of the substrate 111. The liquid moving to the radial outside may cause the shortage of the liquid near the center of the polishing head 120. Therefore, the liquid discharge port 127 is preferably provided near the center of the lower surface of the polishing head 120. Providing the liquid discharge port 127 at the center of the lower surface of the polishing head 120 allows a sufficient amount of the liquid to be supplied to the center of the polishing pad 121. However, it is also possible to provide the liquid discharge port 127 at a part other than the center of the lower surface of the polishing head 120. The number of the liquid discharge ports 127 is not limited. The detail of the liquid reservoir portion 126 will be described below using FIGS. 2A and 2B.

The liquid supply nozzle 130 is disposed to supply the liquid such as a polishing liquid, a chemical liquid, and/or a cleaning liquid held in a liquid source 131 to the polishing apparatus 100. More specifically, the liquid supply nozzle 130 is disposed to drop or flow down the liquid from above the polishing head 120 to the liquid reservoir portion 126. The liquid source 131 may be an element that constitutes a part of the polishing apparatus 100. Additionally or alternatively, it is also possible to use a liquid source 131 that is separated and independent from the polishing apparatus 100. Preferably, the polishing apparatus 100 includes a flow rate adjustment apparatus 132 for adjusting an amount of the liquid supplied from the liquid supply nozzle 130. The flow rate adjustment apparatus 132 may be controlled by the control unit 140. In FIG. 1, one liquid source 131 is connected to one liquid supply nozzle 130. Alternatively, a plurality of liquid sources 131 may be connected to one liquid supply nozzle 130. When the plurality of liquid sources 131 are connected to the one liquid supply nozzle 130, a plurality of kinds of liquids can be supplied from the one liquid supply nozzle 130. Furthermore, the number of the liquid supply nozzles 130 is not limited to one. When the plurality of liquid supply nozzles 130 are disposed, one or a plurality of different and independent liquid sources 131 may be connected to each liquid supply nozzle 130. Meanwhile, when the plurality of liquid supply nozzles 130 are disposed, one liquid source 131 may be connected to the plurality of liquid supply nozzles 130.

The liquid supply nozzle 130 is not rotated by the rotation apparatus 122. In other words, even while the rotation apparatus 122 is rotating the polishing head 120, the liquid supply nozzle 130 is not rotated by the rotation apparatus 122. Accordingly, when the liquid is supplied from the liquid source 131 to the liquid reservoir portion 126, the liquid does not need to pass through the inside of a rotating component. Therefore, with the configuration in FIG. 1, it is not necessary to dispose a rotary joint on the polishing apparatus 100. However, a configuration where the rotary joint (for example, a rotary joint for supplying cleaning water) is applied to the configuration in FIG. 1 is not excluded from the scope.

The liquid supply nozzle 130 may be configured to be moved by the up-and-down motion apparatus 124 and/or the horizontal movement apparatus 125. Configuring the liquid supply nozzle 130 to be moved by the up-and-down motion apparatus 124 and/or the horizontal movement apparatus 125 facilitates the liquid supply nozzle 130 to follow a parallel movement of the polishing head 120. Meanwhile, the liquid supply nozzle 130 may be configured not to be moved by the up-and-down motion apparatus 124 and/or the horizontal movement apparatus 125. It is thought that giving the liquid supply nozzle 130 independence from the up-and-down motion apparatus 124 and/or the horizontal movement apparatus 125 one another improves a freedom of design of the apparatus and facilitates replacement of the liquid source 131. It is also possible to further dispose a moving apparatus for moving the liquid supply nozzle 130 that is separated and independent from the up-and-down motion apparatus 124 and the horizontal movement apparatus 125.

Figure 2A:
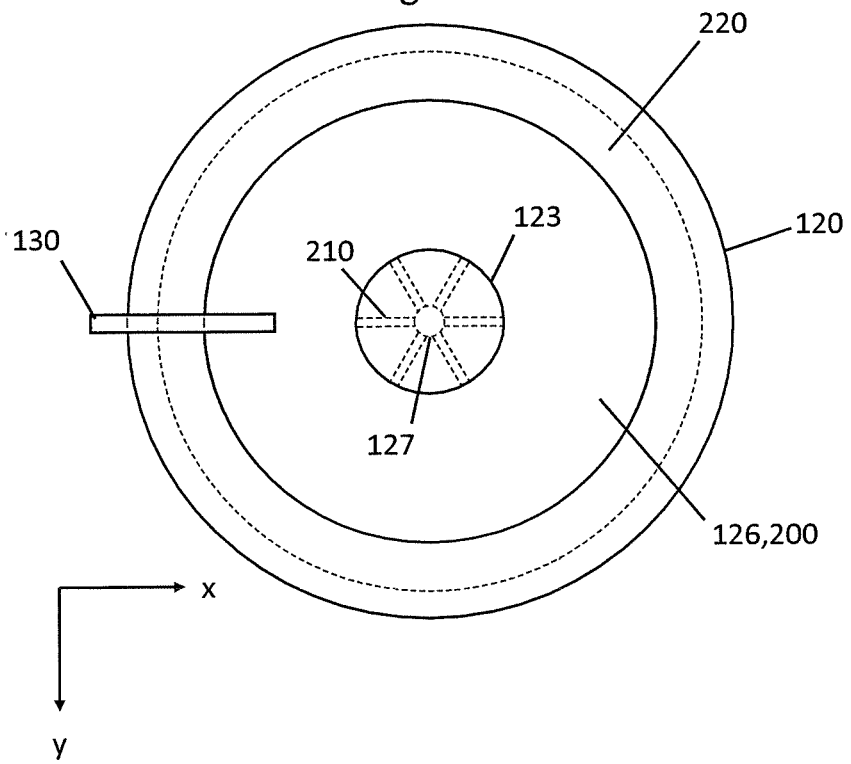
FIG. 2A is a top view of a polishing head and a liquid supply nozzle according to the one embodiment.
Figure 2B:
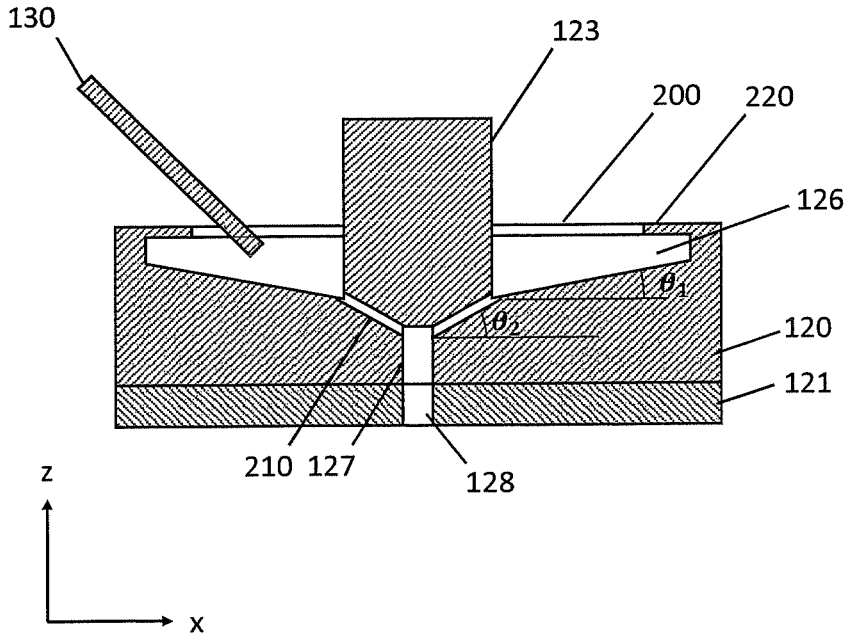
FIG. 2B is a front cross-sectional view of the polishing head according to the one embodiment.

The following describes the detail of the liquid reservoir portion 126 using FIGS. 2A and 2B. FIG. 2A is a top view of the polishing head 120. FIG. 2B is a front cross-sectional view of the polishing head 120. The liquid supply nozzle 130 is also illustrated in FIG. 2A and FIG. 2B. Further, the polishing pad 121 is also illustrated in FIG. 2B.

A depressed portion that is annular when viewing from above is formed on the upper portion of the polishing head 120 and around the shaft 123, namely, formed on the upper portion of the polishing head 120 and around the rotation axis of the polishing head 120. A space defined by this depressed portion acts as the liquid reservoir portion 126 for receiving the liquid supplied from the liquid supply nozzle 130. Instead of forming the liquid reservoir portion 126 from the depressed portion, the liquid reservoir portion 126 may be formed from another member such as a cylindrically-shaped member disposed on the top surface of the polishing head 120.

An annular opening 200 is formed on the upper portion of the polishing head 120 and around the shaft 123, namely, formed on the upper portion of the polishing head 120 and around the rotation axis of the polishing head 120. In the example in FIGS. 2A and 2B, an overhang portion 220, which is described later, defines the opening 200. When the overhang portion 220, which is described later, is not disposed, the depressed portion formed on the upper portion of the polishing head 120 may define the annular opening 200. The liquid reservoir portion 126 is communicated with a space outside the polishing head 120 via the opening 200. Accordingly, the liquid supplied from the liquid supply nozzle 130 can reach the liquid reservoir portion 126 via the opening 200 while the polishing head 120 is rotating.

As understood from FIGS. 2A and 2B, the liquid reservoir portion 126 is positioned on the upper portion of the polishing head 120 with respect to the liquid discharge port 127. Accordingly, the liquid received by the liquid reservoir portion 126 moves down in accordance with the gravity to be discharged from the liquid discharge port 127.

During the polishing of the substrate 111, the liquid supplied to the liquid reservoir portion 126 is exposed to the centrifugal force. That is, the liquid receives a force in a direction separating from the center of the polishing pad 121. In order to supply the liquid to the center of the polishing pad 121 against the centrifugal force, the liquid reservoir portion 126 in FIGS. 2A and 2B preferably has a bottom surface that is inclined in a cone shape. Inclining the bottom surface of the liquid reservoir portion 126 allows the liquid to flow toward the center of the polishing head 120 by gravity. The bottom surface of the liquid reservoir portion 126 has an inclination angle $\theta_1$ that may be determined considering various kinds of parameters such as a rotation speed of the polishing head 120, dimensions of the polishing head 120, a property of the liquid supplied from the liquid supply nozzle 130, and an amount of the liquid that should be supplied to the polished surface of the polishing pad 121. For example, $\theta_1$ is a value larger than 5° and smaller than 85°.

The polishing head 120 further has a flow passage 210 that connects the liquid reservoir portion 126 to the liquid discharge port 127. Providing the flow passage 210 facilitates the connection between the liquid reservoir portion 126 and the liquid discharge port 127. However, it is also possible to employ a configuration where the liquid reservoir portion 126 is directly connected to the liquid discharge port 127. Preferably, the flow passage 210 is configured to connect the liquid discharge port 127 to a part positioned on the lowest portion of the liquid reservoir portion 126. In the example in FIGS. 2A and 2B, six flow passages 210 are provided at every 60°. However, the configuration of the flow passage 210 is not limited to the example illustrated in FIGS. 2A and 2B. The specific configuration of the flow passage 210 may be determined considering various kinds of parameters such as the property of the liquid supplied from the liquid supply nozzle 130, and the amount of the liquid that should be supplied to the polished surface of the polishing pad 121. Similarly to the bottom surface of the liquid reservoir portion 126, the flow passage 210 also may be inclined. The flow passage 210 has an inclination angle $\theta_2$ that may be larger or smaller than $\theta_1$. $\theta_2$ may be determined considering various kinds of parameters such as the rotation speed of the polishing head 120, the dimensions of the polishing head 120, the property of the liquid supplied from the liquid supply nozzle 130, and the amount of the liquid that should be supplied to the polished surface of the polishing pad 121. For example, $\theta_2$ is a value larger than 5° and smaller than 85°, and a value larger than $\theta_1$.

The liquid reservoir portion 126 in FIGS. 2A and 2B is not sealed. Accordingly, when the polishing pad 121 illustrated in FIGS. 2A and 2B is used, the liquid may spout out from the liquid reservoir portion 126. The liquid inside the liquid reservoir portion 126 may receive the centrifugal force. Thus, it is thought that the liquid is likely to spout especially from an outer peripheral portion of the liquid reservoir portion 126.

Therefore, the polishing head 120 in FIGS. 2A and 2B includes the overhang portion 220 for preventing the liquid from spouting from the liquid reservoir portion 126. The overhang portion 220 illustrated in FIGS. 2A and 2B is disposed to extend from an outer wall of the liquid reservoir portion 126 toward the rotation axis of the polishing head 120. That is, the overhang portion 220 extends toward a radial inside of the opening 200. The overhang portion 220 also can be expressed as a part in a shape of a rat guard. FIGS. 2A and 2B illustrate the overhang portion 220 as being integrally formed with the other part of the polishing head 120. Alternatively, the overhang portion 220 may be configured from a component independent from the other part of the polishing head 120.

The liquid that attempts to spout out from the liquid reservoir portion 126 is received by the overhang portion 220. Accordingly, disposing the overhang portion 220 can prevent the liquid from spouting from the liquid reservoir portion 126. When the overhang portion 220 is disposed, the overhang portion 220 may define the opening 200. When the overhang portion 220 has a large projecting amount, the spouting of the liquid can be more effectively prevented. Meanwhile, when the projecting amount of the overhang portion 220 is large, the opening 200 may have a small size. When the size of the opening 200 is small, it is thought that the supply of the liquid from the liquid supply nozzle 130 is difficult. The projecting amount of the overhang portion 220 may be determined considering various kinds of parameters such as the rotation speed of the polishing head 120, the dimensions of the polishing head 120, the property of the liquid supplied from the liquid supply nozzle 130, and ease of supply of the liquid from the liquid supply nozzle 130. An additional overhang portion may be disposed on the upper portion and/or the lower portion of the overhang portion 220 in FIGS. 2A and 2B.

Figure 3A:
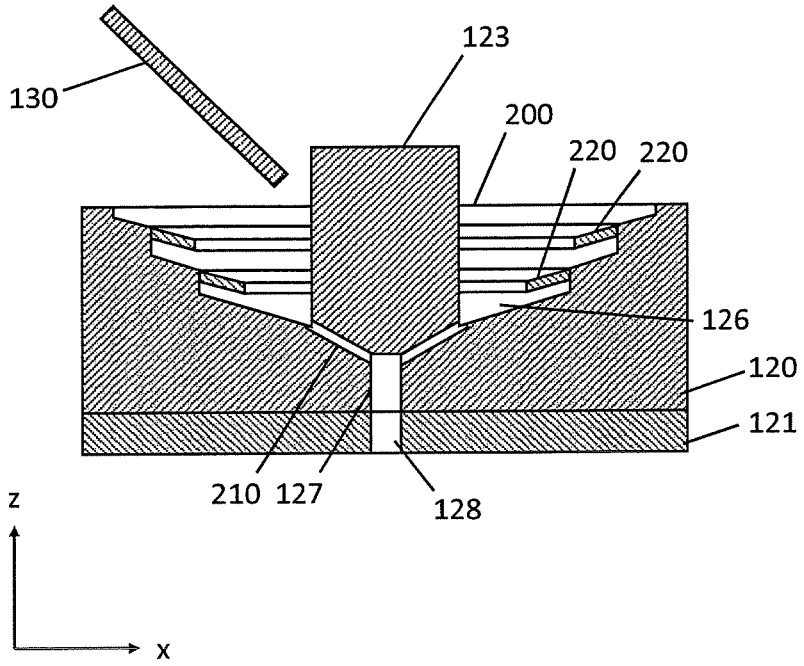
FIG. 3A is a front cross-sectional view of a polishing head where an overhang portion is provided on a bottom surface of a liquid reservoir portion.

Unlike FIGS. 2A and 2B, the overhang portion 220 may be disposed on a bottom surface of the liquid reservoir portion 126. FIG. 3A is a front cross-sectional view of a polishing head 120 where the overhang portions 220 are disposed on the bottom surface of the liquid reservoir portion 126. In the example in FIG. 3A, two overhang portions 220 are illustrated, but the number of the overhang portions 220 may be one, or, may be three or more. Each of the overhang portions 220 in FIG. 3A is a component independent from the other part of the polishing head 120. However, the overhang portions 220 may be integrally formed with the other part of the polishing head 120.

When the overhang portions 220 are disposed on the bottom surface of the liquid reservoir portion 126, the bottom surface of the liquid reservoir portion 126 is preferably configured into a at least two-stage staircase pattern (three-stage in the example in FIG. 3A: here, the number of the bottom surface(s) that is divided by the stairs (i.e. the number obtained by adding one to the number of "corner(s)" of the stairs) is defined as "the number of the stages"). The overhang portions 220 are preferably configured to extend from a part bulging into a staircase pattern of the liquid reservoir portion 126 toward the rotation axis of the polishing head 120. That is, also in the example in FIG. 3A, similarly to the example in FIGS. 2A and 2B, the overhang portions 220 extend toward the radial inside of the opening 200. The overhang portions 220 divide the liquid reservoir portion 126 into a plurality of regions. At least one region among the regions of the liquid reservoir portion 126 has a diameter smaller than a diameter of the entire liquid reservoir portion 126. For example, when overhang portions 220 having an L-shaped cross section are used, the bottom surface of the liquid reservoir portion 126 does not have to have the staircase pattern. The bottom surface of the liquid reservoir portion 126 is preferably inclined. However, the bottom surface of the liquid reservoir portion 126 does not have to be inclined. When the bottom surface of the liquid reservoir portion 126 is formed into the staircase pattern, the inclination angles of the respective stages may be all identical or may be different for each stage.

The overhang portions 220 in FIG. 3A that are positioned higher than the liquid surface of the liquid inside the liquid reservoir portion 126 can prevent the liquid from spouting. When at least one overhang portion 220 exists at a position higher than the liquid surface, the liquid that has received the centrifugal force is stopped by the overhang portion 220 before reaching the outer wall of the liquid reservoir portion 126. Accordingly, the overhang portions 220 in FIG. 3A can prevent the liquid from reaching the outermost periphery of the liquid reservoir portion 126, and thereby, may facilitate the discharge from the liquid discharge port 127 of the liquid.

The overhang portions 220 in FIG. 3A are disposed on the bottom surface of the liquid reservoir portion 126. Thus, when there is a relatively large amount of liquid in the liquid reservoir portion 126, some or all of the overhang portions 220 in FIG. 3A may be immersed in the liquid. The overhang portions 220 immersed in the liquid subdivide the flow of the liquid inside the liquid reservoir portion 126. The flow of the liquid will be described using FIG. 3B.

Figure 3B:
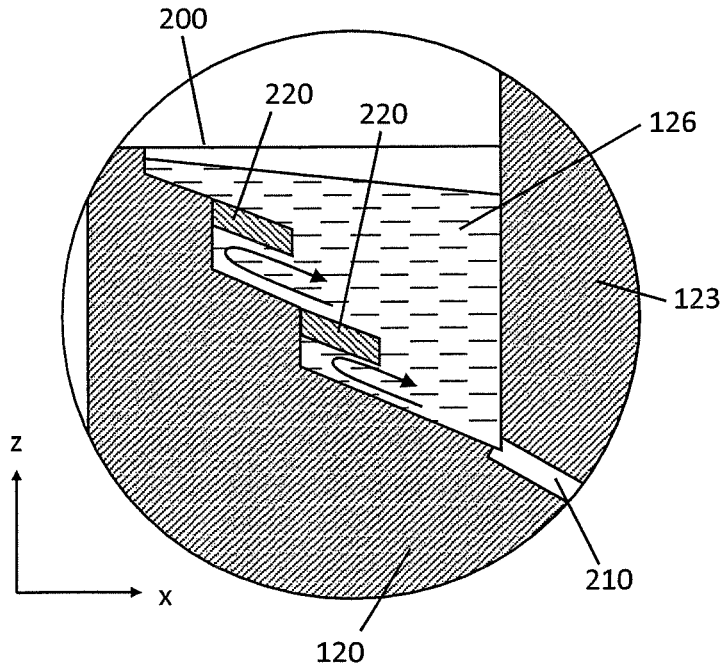
FIG. 3B is an enlarged view around the overhang portion in FIG. 3A.

FIG. 3B is an enlarged view around the overhang portions 220 in FIG. 3A. However, for convenience in the illustration, an aspect ratio in FIG. 3A is different from an aspect ratio in FIG. 3B. In FIG. 3B, all the overhang portions 220 are immersed in the liquid. The polishing head 120 is rotating. Accordingly, the liquid in the liquid reservoir portion 126 is receiving the centrifugal force. As a result of receiving the centrifugal force, the liquid surface may incline.

In the configuration where the overhang portion 220 is not disposed on the bottom surface of the liquid reservoir portion 126 (see FIGS. 2A and 2B), the centrifugal force may generate the flow of the liquid from an inner wall toward the outer wall of the liquid reservoir portion 126 to cause all the liquid to reach the outer wall of the liquid reservoir portion 126. Meanwhile, as denoted by arrows in FIG. 3B, when the overhang portions 220 are disposed on the bottom surface of the liquid reservoir portion 126, the flow of the liquid is inhibited by the overhang portions 220. As a result, at least a part of the liquid inside the liquid reservoir portion 126 does not reach the outer wall of the liquid reservoir portion 126, and thus the liquid may be likely to be discharged from the liquid discharge port 127.

The overhang portion 220 in FIGS. 2A and 2B is horizontally disposed. The overhang portions 220 in FIGS. 3A and 3B are disposed to incline downward. Unlike the overhang portions illustrated in FIGS. 2A and 2B and FIGS. 3A and 3B, an overhang portion 220 that inclines above may be used. Insofar as the scatter of the liquid inside the liquid reservoir portion 126 can be prevented and/or the flow of the liquid inside the liquid reservoir portion 126 can be turned in a center direction, the inclination angle of the overhang portion 220 has no limit.

Unlike the configurations illustrated in FIGS. 2A and 2B and FIGS. 3A and 3B, a polishing head 120 without the overhang portion 220 can be used. When the overhang portion 220 is not disposed on the polishing head 120, the scatter of the liquid is preferably prevented by deepening a depth of the liquid reservoir portion 126 (heightening a height of the liquid reservoir portion 126).

Figure 4:
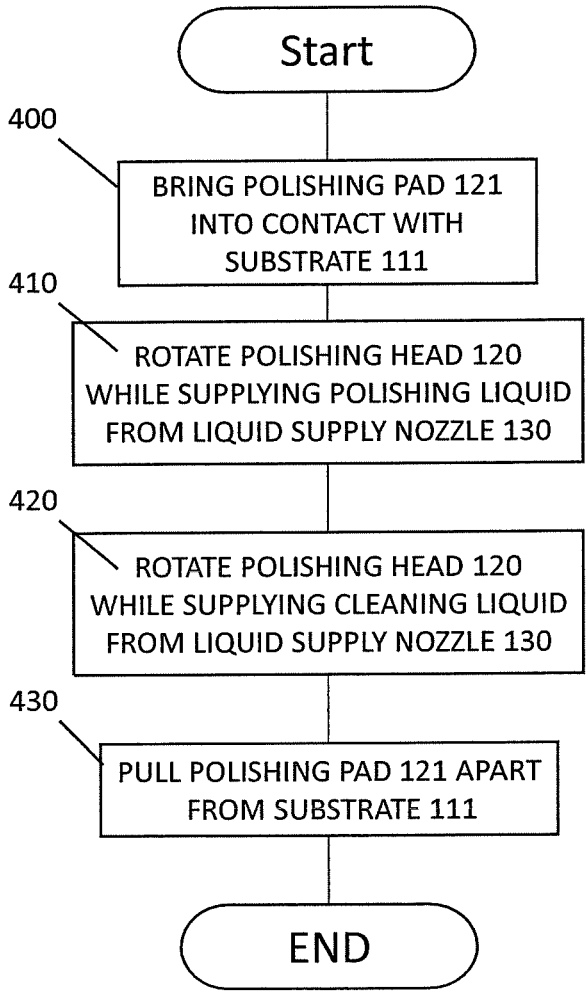
FIG. 4 is a flowchart describing a polishing method according to the one embodiment.

FIG. 4 illustrates a flowchart when the substrate 111 is polished using any of the polishing heads 120 described above. For convenience in the description, at the start of the flowchart, it is considered that the substrate 111 does not contact the polishing pad 121 and there is substantially no polishing liquid in the liquid reservoir portion 126.

Step 400: The control unit 140 controls the up-and-down motion apparatus 124 and/or the horizontal movement apparatus 125 to bring the polishing pad 121 into contact with the substrate 111. When the polishing apparatus 100 includes moving apparatus other than the up-and-down motion apparatus 124 and the horizontal movement apparatus 125, these moving apparatuses also may be controlled by the control unit 140.

Step 410: The control unit 140 controls the liquid source 131 (or, for example, a pump connected to the liquid source 131) to supply the polishing liquid from the liquid supply nozzle 130 to the liquid reservoir portion 126. When the flow rate adjustment apparatus 132 is disposed, the flow rate adjustment apparatus 132 also may be controlled by the control unit 140. Furthermore, the control unit 140 controls the rotation apparatus 122 while supplying the polishing liquid from the liquid supply nozzle 130 to rotate the polishing head 120. Step 400 has made the substrate 111 be in contact with the polishing pad 121. Thus, the rotation of the polishing head 120 polishes the substrate 111.

At Step 410, a timing to start the supply of the polishing liquid may be identical to a timing to start the rotation of the polishing head 120. However, it is not necessary that the timing to start the supply of the polishing liquid is identical to the timing to start the rotation of the polishing head 120. For example, the polishing liquid may be supplied prior to the rotation of the polishing head 120, and the rotation of the polishing head 120 may be started after waiting until the polishing liquid reaches the polished surface of the polishing pad 121. Conversely, after the rotation of the polishing head 120 is started, the polishing liquid may be supplied to the liquid reservoir portion 126. At Step 410, the polishing liquid with an amount approximately identical to an amount of the polishing liquid discharged from the liquid discharge port 127 per unit time is preferably supplied per unit time. That is, a discharge rate of the polishing liquid is preferably comparable with a supply rate of the polishing liquid. The "amount of the polishing liquid discharged from the liquid discharge port 127" can be also expressed as an "amount of the polishing liquid consumed during polishing processing." Making the discharge amount (consumed amount) of the polishing liquid be approximately identical to the supply amount of the polishing liquid can prevent shortage of the polishing liquid on the polished surface of the polishing pad 121, while preventing overflow of the polishing liquid from the liquid reservoir portion 126. Furthermore, making the discharge amount of the polishing liquid be approximately identical to the supply amount of the polishing liquid can stabilize an amount of the polishing liquid existing near the polished surface of the polishing pad 121. Stabilizing the amount of the polishing liquid existing near the polished surface may lead stable polishing processing.

Step 420: After the end of the polishing at Step 410, the control unit 140 controls the liquid source 131 to supply the cleaning liquid from the liquid supply nozzle 130 to the liquid reservoir portion 126. When the flow rate adjustment apparatus 132 is disposed, the flow rate adjustment apparatus 132 also may be controlled by the control unit 140. Furthermore, the control unit 140 controls the rotation apparatus 122 while supplying the cleaning liquid from the liquid supply nozzle 130 to rotate the polishing head 120. Step 400 has made the substrate 111 be in contact with the polishing pad 121. Thus, the rotation of the polishing head 120 cleans the substrate 111. At the same time as the cleaning of the substrate 111, the liquid reservoir portion 126, the pad hole 128, the flow passage 210, and the like are also cleaned.

In transition from Step 410 to Step 420, the control unit 140 may once stop the rotation of the polishing head 120. As another example, the control unit 140 may transition from Step 410 to Step 420 as continuing the rotation of the polishing head 120. Between Step 410 and Step 420, a step of determining the end of the polishing with a sensor (not illustrated) or the like may be added. At Step 410 and/or Step 420, the horizontal movement apparatus 125 may horizontally move the polishing head 120 during the rotation of the polishing head 120.

Step 430: The control unit 140 controls the up-and-down motion apparatus 124 and/or the horizontal movement apparatus 125 to pull the polishing pad 121 apart from the substrate 111. "Pull . . . apart" is a term that means, for example, "make an object contactless, separate the object or make the object be in an unbound state." "Pull . . . apart" is not a term limited to a behavior as "PULL the object to separate it from another member."

As understood from FIGS. 2A and 2B and FIGS. 3A and 3B, a lid for closing the pad hole 128 is not disposed on the polishing head 120 according to the one embodiment. Accordingly, when the polishing pad 121 does not contact the substrate 111 in the polishing head 120 according to the one embodiment, in other words, when the polishing head 120 has been lifted, the liquid may leak out from the pad hole 128. In the flowchart in FIG. 4, after the substrate 111 is brought into contact with the polishing pad 121, the polishing liquid is supplied to the liquid reservoir portion 126. This can prevent the polishing liquid from unintentionally leaking out from the pad hole 128. In the flowchart in FIG. 4, after the polishing of the substrate 111, the liquid reservoir portion 126, the pad hole 128, the flow passage 210, and the like are cleaned. When the polishing pad 121 is pulled apart from the substrate 111 after the cleaning, even if the liquid leaks out from the pad hole 128, most of the liquid that leaks out is the cleaning liquid. Accordingly, polishing the substrate 111 in accordance with the flowchart in FIG. 4 can prevent the polishing liquid from leaking out from the pad hole 128.

Adding a step(s) to the flowchart in FIG. 4, alternating the step(s) illustrated in the flowchart in FIG. 4 with another/other step(s), and deleting the step(s) illustrated in the flowchart in FIG. 4 are possible. For example, when a moving apparatus for moving the liquid supply nozzle 130 is disposed, a step of moving the liquid supply nozzle 130 to above the opening 200 may be added prior to the move of the polishing pad 121, at the same time as the move of the polishing pad 121, or after the move of the polishing pad 121. As another example, a step of dressing the polishing pad 121 with a dresser (not illustrated) may be added after Step 430. As yet another example, instead of Step 410 and/or Step 430, a step of supplying the liquid (the polishing liquid or the cleaning liquid) with a sufficient amount from the liquid supply nozzle 130 to the liquid reservoir portion 126, stopping the supply of liquid, and subsequently rotating the polishing head 120 can be employed. A user, not the control unit 140, may manually control the respective elements. The up-and-down motion, the horizontal movement, and/or the rotation of the polishing head 120 are not necessary performed by the up-and-down motion apparatus 124, the horizontal movement apparatus 125, and/or the rotation apparatus 122. When the polishing apparatus 100 includes a moving apparatus for the up-and-down motion and/or the horizontal movement of the surface plate 110, Step 400 and Step 430 may be performed by the moving apparatus for the surface plate 110. For example, the polishing head 120 may be moved or rotated by, for example, an actuator independent from the polishing apparatus 100. In an extreme example, the user may move or rotate the polishing head 120. The polishing may be performed in accordance with a method other than the method illustrated in the flowchart in FIG. 4.

Figure 5:
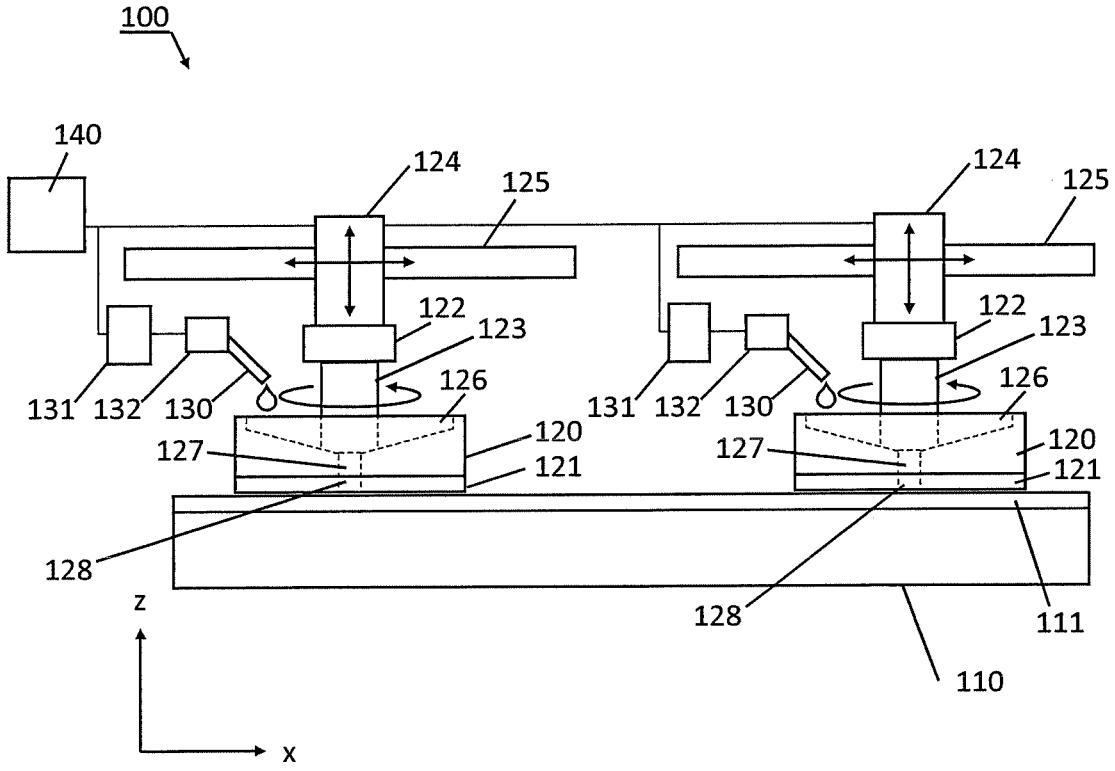
FIG. 5 is a front view of a polishing apparatus according to one embodiment, including a plurality of polishing heads.

As a modification of the polishing apparatus 100, a polishing apparatus 100 including a plurality of polishing heads 120 can be used. FIG. 5 is a front view of the polishing apparatus 100 including the plurality of polishing heads 120. It is thought that including the plurality of polishing heads 120 improves a polishing efficiency of the substrate 111 to improve the throughput of the polishing apparatus 100. Accordingly, the polishing apparatus 100 in FIG. 5 has an advantage in polishing a relatively large-sized substrate 111. Including the plurality of polishing heads 120 may allow a substrate 111 having a complicated shape (a substrate that does not have a circular shape) to be easily polished.

In the foregoing, several embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective constituent elements described in the claims and specification in a range in which at least a part of the above described problems can be solved, or a range in which at least a part of the effects can be exhibited.

This application discloses a polishing head for a face-up type polishing apparatus used by attaching a polishing pad on a lower surface as one embodiment. The polishing head includes a liquid reservoir portion that receives a liquid and a liquid discharge port that discharges the liquid received by the liquid reservoir portion. The liquid reservoir portion is disposed around a rotation axis of the polishing head. The liquid discharge port is disposed on a lower surface of the polishing head. An annular opening centering on the rotation axis of the polishing head is formed on an upper portion of the polishing head. The liquid reservoir portion is communicated with a space outside the polishing head via the opening.

This polishing head provides an effect that can supply the polishing liquid without the rotary joint as one example.

Further, this application discloses the polishing head where the liquid reservoir portion has a bottom surface that is inclined in a cone shape as one embodiment.

This polishing head provides an effect that can flow the liquid toward the center of the polishing head by gravity as one example.

Further, this application discloses the polishing head further including an overhang portion extending from an outer edge of the liquid reservoir portion toward the rotation axis of the polishing head as one embodiment.

This polishing head provides an effect that can prevent the liquid from spouting out from the liquid reservoir portion as one example.

Further, this application discloses the polishing head including a flow passage that connects the liquid reservoir portion to the liquid discharge port as one embodiment.

This polishing head provides an effect that can easily connect the liquid reservoir portion to the liquid discharge port as one example.

Further, this application discloses the polishing head where the liquid discharge port is provided at a center of the lower surface of the polishing head as one embodiment.

This polishing head provides an effect that can supply the liquid with a sufficient amount to the center of the polishing pad 121 as one example.

Further, this application discloses a polishing apparatus including a surface plate that detachably supports a substrate to a top surface, the polishing head according to any one of the disclosed embodiment is disposed to face the surface plate, and a liquid supply nozzle that supplies a liquid to the liquid reservoir portion via the opening of the polishing head as one embodiment.

This disclosure clarifies the apparatus to which the polishing head according to any of the embodiments is applied.

Further, this application discloses a polishing method using the polishing apparatus according to one embodiment as one embodiment. The polishing method includes (a) a step of bringing a polishing pad into contact with the substrate, (b) a step of rotating the polishing head while supplying a polishing liquid from the liquid supply nozzle to the liquid reservoir portion, (c) a step of rotating the polishing head while supplying a cleaning liquid from the liquid supply nozzle to the liquid reservoir portion, and (d) a step of pulling the polishing pad apart from the substrate.

This polishing method provides an effect that can prevent the polishing liquid from leaking out from the pad hole as one example.

Further, this application discloses the polishing method where the polishing apparatus further includes a rotation apparatus that rotates the polishing head, and the rotation of the polishing head at the step (b) and the step (c) is performed by the rotation apparatus as one embodiment. Further, this application discloses the polishing method where the polishing apparatus further includes an up-and-down motion apparatus that moves the polishing head up and down, and bringing the polishing pad into contact with the substrate at the step (a) and pulling the polishing pad apart from the substrate at the step (d) are performed by the up-and-down motion apparatus as one embodiment.

These disclosures define the detail of the polishing apparatus for executing the polishing method.

Further, this application discloses the polishing method where a supply amount per unit time of the polishing liquid at the step (b) is identical to a discharge amount per unit time from the liquid discharge port of the polishing liquid as one embodiment.

This polishing method provides an effect that can prevent the shortage of the polishing liquid on the polished surface of the polishing pad and can prevent the overflow of the polishing liquid from the liquid reservoir portion as one example.

REFERENCE SIGNS LIST

100 . . . polishing apparatus
110 . . . surface plate
111 . . . substrate
120 . . . polishing head
121 . . . polishing pad
122 . . . rotation apparatus
123 . . . shaft
124 . . . up-and-down motion apparatus
125 . . . horizontal movement apparatus

126 . . . liquid reservoir portion
127 . . . liquid discharge port
128 . . . pad hole
130 . . . liquid supply nozzle
131 . . . liquid source
132 . . . flow rate adjustment apparatus
140 . . . control unit
200 . . . opening
210 . . . flow passage
220 . . . overhang portion

What is claimed is:

1. A polishing head for a polishing apparatus that holds a substrate such that a polished surface of the substrate faces upward, the polishing head comprising:

a liquid reservoir portion that receives a liquid, the liquid reservoir portion being disposed around a rotation axis of the polishing head; and a liquid discharge port that discharges the liquid received by the liquid reservoir portion, the liquid discharge port being disposed on a lower surface of the polishing head, wherein an annular opening centering on the rotation axis of the polishing head is formed on an upper portion of the polishing head, and the liquid reservoir portion is communicated with a space outside the polishing head via the opening, the liquid reservoir portion has a bottom surface and an outer wall, an overhang portion disposed on the outer wall of the liquid reservoir portion the overhang portion extending toward a radial inside of the opening.

2. The polishing head according to claim 1, wherein the bottom surface of the liquid reservoir is inclined in a cone shape.

3. The polishing head according to claim 1, comprising a flow passage that connects the liquid reservoir portion to the liquid discharge port.

4. The polishing head according to claim 1, wherein the liquid discharge port is provided at a center of the lower surface of the polishing head.

5. A polishing apparatus comprising:

a surface plate that detachably supports a substrate to a top surface;

the polishing head according to claim 1, the polishing head being disposed to face the surface plate; and a liquid supply nozzle that supplies a liquid to the liquid reservoir portion via the opening of the polishing head.

6. A polishing method using the polishing apparatus according to claim 5, the polishing method comprising:

(a) bringing a polishing pad attached on the lower surface of the polishing head into contact with the substrate;

(b) rotating the polishing head while supplying a polishing liquid from the liquid supply nozzle to the liquid reservoir portion (c) rotating the polishing head while supplying a cleaning liquid from the liquid supply nozzle to the liquid reservoir portion; and (d) pulling the polishing pad apart from the substrate.

7. The polishing method according to claim 6, wherein the polishing apparatus further includes a rotation apparatus that rotates the polishing head, and the rotation of the polishing head at said (b) and said (c) is performed by the rotation apparatus.

8. The polishing method according to claim 6, wherein the polishing apparatus further includes an up-and-down motion apparatus that moves the polishing head up and down, and bringing the polishing pad into contact with the substrate at said (a) and pulling the polishing pad apart from the substrate at said (d) are performed by the up-and-down motion apparatus.

9. The polishing method according to claim 6, wherein a supply amount per unit time of the polishing liquid at said (b) is identical to a discharge amount per unit time from the liquid discharge port of the polishing liquid.

10. The polishing head according to claim 1, wherein the bottom surface of the liquid reservoir portion is configured into a at least two-stage staircase pattern.

11. The polishing head according to claim 10, wherein the overhang portion is configured to extend from a part bulging into a staircase pattern of the liquid reservoir portion toward the rotation axis of the polishing head.

12. The polishing head according to claim 1, wherein the overhang portion divides the liquid reservoir portion into a plurality of regions.

13. The polishing head according to claim 12, wherein at least one region among the regions of the liquid reservoir portion has a diameter smaller than a diameter of the entire liquid reservoir portion.

14. The polishing head according to claim 1, wherein the overhang portion having an L-shaped cross section.

* * * * *